United States Patent [19]

Ferree

[11] 4,346,550

[45] Aug. 31, 1982

[54] TAPE WRAPPING APPARATUS

[75] Inventor: Herbert E. Ferree, Hempfield Township, Westmoreland County, Pa.

[73] Assignee: Westinghouse Electric Corp., Pittsburgh, Pa.

[21] Appl. No.: 163,551

[22] Filed: Jun. 27, 1980

[51] Int. Cl.[3] ..... D07B 7/14; B65H 81/08

[52] U.S. Cl. ..... 57/10; 57/3; 242/7.08

[58] Field of Search ..... 57/3, 6, 10, 31; 242/7.06, 7.08, 7.09, 156.1

[56] References Cited

U.S. PATENT DOCUMENTS

| | | | |
|---|---|---|---|
| 2,813,392 | 11/1957 | Woosey | 57/10 |
| 3,006,136 | 10/1961 | Grieve et al. | 57/3 |
| 3,374,615 | 3/1968 | Evanicsko | 57/10 |
| 4,198,863 | 4/1980 | Sakaue | 57/10 X |

FOREIGN PATENT DOCUMENTS

| | | | |
|---|---|---|---|
| 697236 | 11/1964 | Canada | 57/10 |
| 648249 | 1/1951 | United Kingdom | 57/10 |

*Primary Examiner*—Donald Watkins
*Attorney, Agent, or Firm*—Benjamin Hudson, Jr.

[57] ABSTRACT

This invention provides a novel and unique hand-held tape wrapping apparatus that is comprised generally of a support frame with a rotating plate mounted to the frame. Means of mounting a roll of tape or spool of similar material to the rotating plate is provided with a constant tension control applied directly to the tape that decreases the tension applied to the tape roll as the tape is unwound. The rotating plate is driven at variable speeds by a trigger controlled air motor that allows the operator to control the speed and easily handle the apparatus as he applies the tape.

3 Claims, 4 Drawing Figures

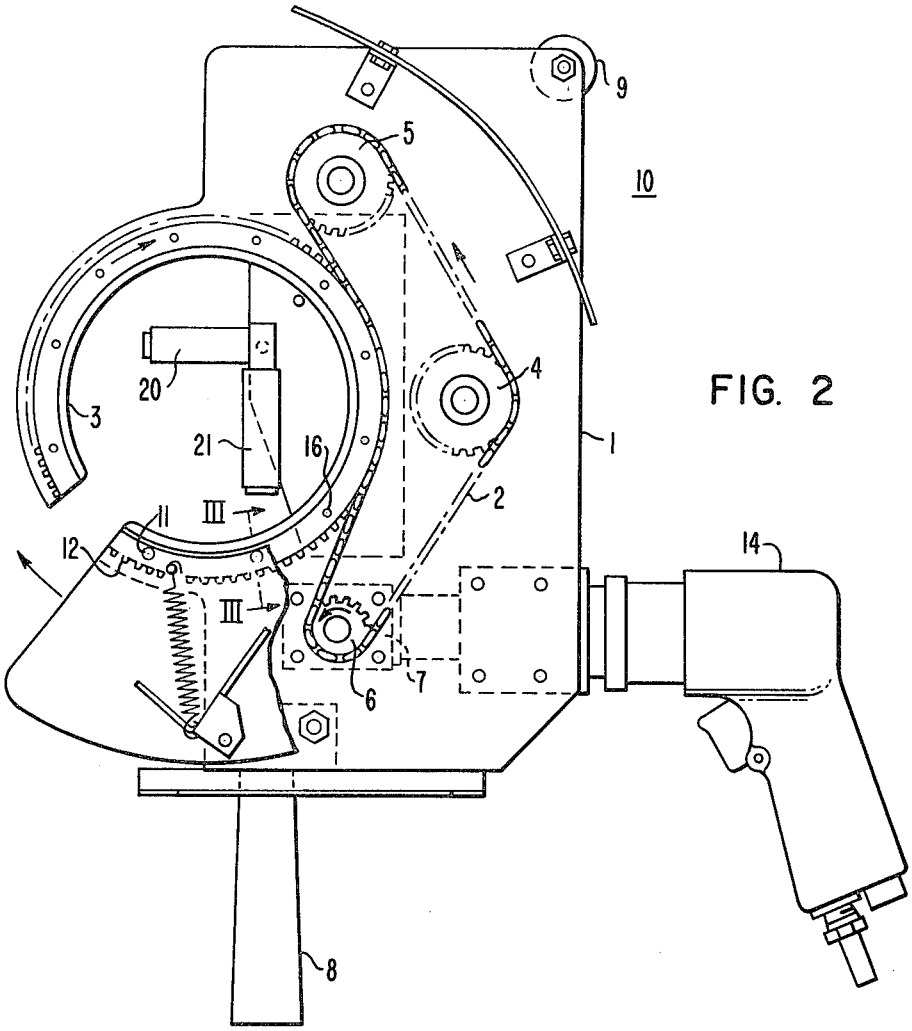
FIG. 2
FIG. 4
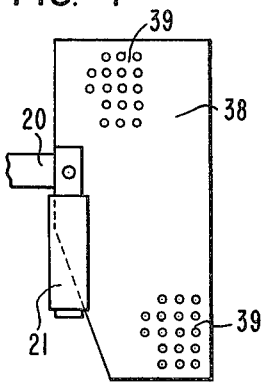
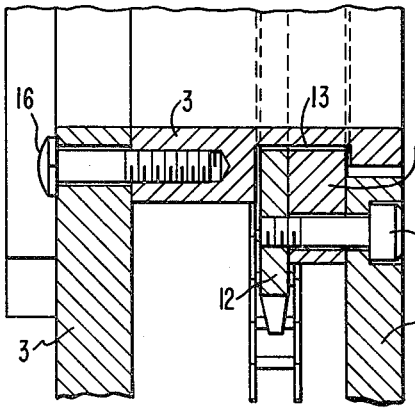
FIG. 3

TAPE WRAPPING APPARATUS

BACKGROUND OF THE INVENTION

1. Field of the Invention

This invention relates generally to machines that wrap rolls of tape or similar materials around generally elongated objects uniformly at a constant tension.

2. Description of the Prior Art

Tapes made of glass cloth, polyester fibers, mica, and many other insulating materials have been used for very many years to insulate the copper or other electrical conducting wires of electric motors, generators, and transformers. These tapes were originally applied by manual methods and a large part of the tape insulation is still applied in this manner for large types of electrical apparatus. Tape wrapping machines such as the one disclosed in U.S. Pat. No. 3,374,615, issued Mar. 26, 1968 to J. Evanisck0, Jr. have been developed to improve the speed and efficiency of tape wrapping operations. A lightweight tape wrapping machine has been needed that would allow operators to apply tape faster and more efficiently. The machine must be light in weight to avoid operator fatigue. The power unit must be light and compact with enough power to wrap the tape at the correct tension at variable speeds. The machine must also have adequate control at slow speeds to tape difficult regions and fast speed to tape the straight portions with as much controlled speed as possible.

SUMMARY OF THE INVENTION

This invention provides a novel and unique hand-held tape wrapping machine that is comprised generally of a support frame with a rotating plate mounted to the frame. Means for mounting a roll of tape or spool of similar material to the rotating plate is provided with a constant tension control applied directly to the tape that decreases the tension applied to the tape roll as the tape is unwound. The rotating plate is driven at variable speeds by a trigger controlled air motor that allows the operator to control the speed and easily handle the machine as the tape is applied.

BRIEF DESCRIPTION OF THE DRAWINGS

FIG. 2 is a front view of the tape wrapping machine with the rotating plate removed;

FIG. 3 is a sectional view taken along the line III—III of FIG. 2; and

FIG. 4 is an isolated view of the positioning bracket removed from the machine as shown in FIG. 2.

DESCRIPTION OF THE PREFERRED EMBODIMENTS

Figure 1:
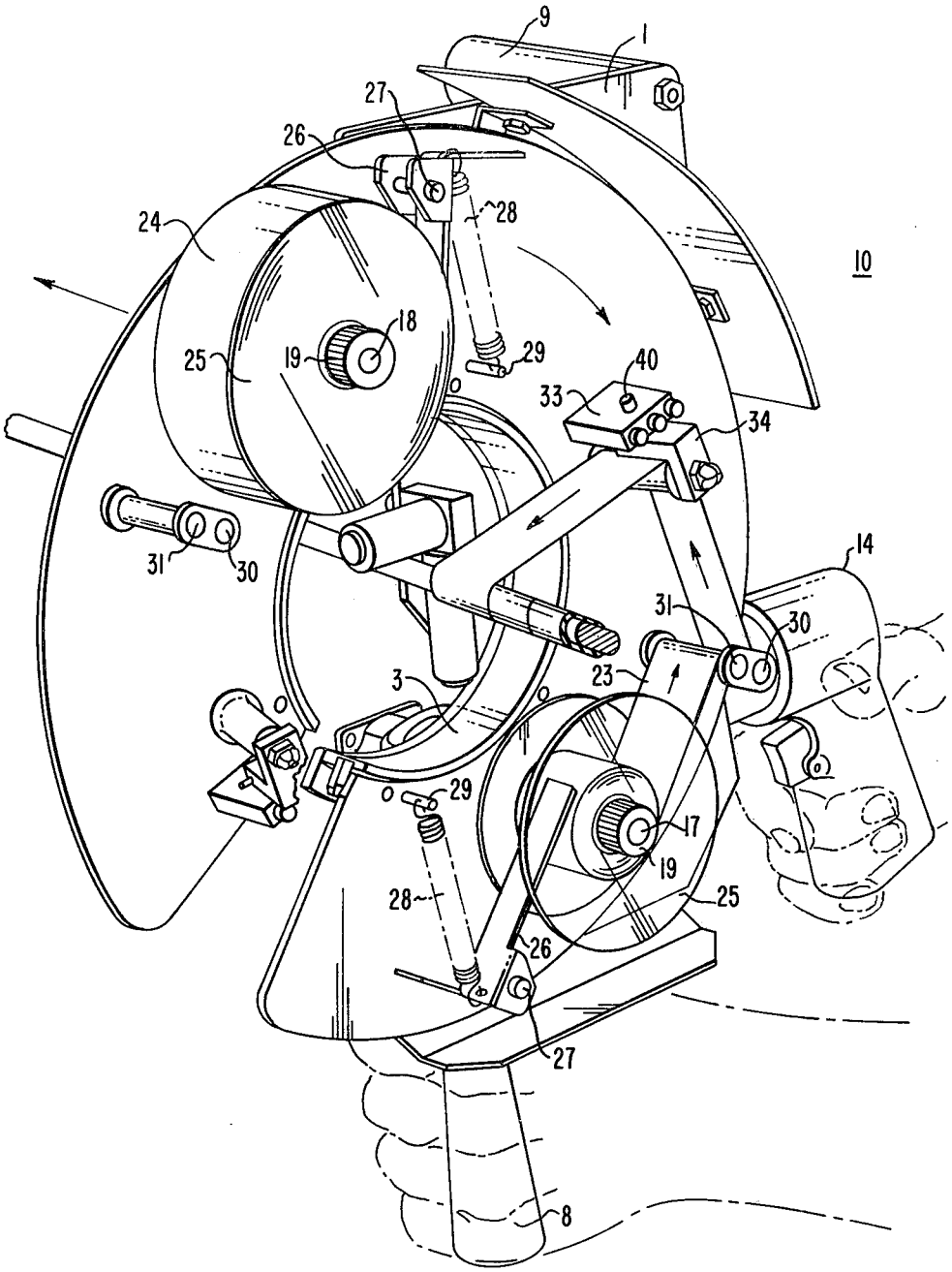
FIG. 1 is a perspective view of the tape wrapping machine made in accordance with the principles of this invention.

Referring to the FIGS. 1 and 2 there is shown a hand-held tape wrapping machine 10. This machine is generally comprised of a metal support frame 1. Connected to the support frame are one drive sprocket 6, and two idler sprockets 4 and 5, arranged as shown. The drive sprocket 6 is connected to a right angle drive 7 which is in turn connected to an air motor 14 in the form of a portable $\frac{3}{8}''$ air drill used as the power unit. This unit provides the power equivalent of $\frac{1}{2}$ horespower with an output speed of 1,000 rpm at 90 pounds per square inch input air pressure, and the speed is trigger controlled with an adjustable stop on the trigger to limit the maximum speed if needed. Since the unit is air powered, it does not tend to overheat, it poses no electrical hazard to the operator, and a built-in muffler keeps the unit relatively quiet. It also supplies the main handle for control of the taping head along with handles 8 and 9 connected to the support frame as shown. There is also connected to the support frame 1 a brass ring 3 by means of screws 11. The ring 3 has a groove 13 that passes along the circumference of the ring. The ring also has a portion cut away so as to give the ring a generally C-shaped configuration. Mounted on the brass ring 3 is a gear-tooth sprocket 12 that rests generally within the groove 13 of the ring 3. The gear-tooth sprocket has a portion cut away that matches the portion cut away from the ring and thus gives the sprocket a C-shaped configuration that matches the shape of the ring. A chain 2 passes around three drive sprockets 4, 5, 6 and the gear tooth sprocket 12 in such a fashion that the chain is disposed to drive the gear tooth sprocket 12 within the groove 13 around the ring 3. A plate 15 is mounted to the gear tooth sprocket 12 by means of several screws 16. The plate has a generally C-shaped configuration that matches the C-shaped configuration of the brass ring 3 and the gear tooth sprocket 12. Connected to the support frame 1 in a position near the center of the brass ring 3, gear tooth sprocket 12, and plate 15 combination are two support rolls 20 and 21 mounted in a position perpendicular and at right angles to each other on a positioning bracket 38. The positioning bracket 38 (seen in FIG. 4) has a multitude of mounting holes 39 that allows the position of the supports to vary depending upon the size of the workpiece. The cut away portion of the ring, gear tooth sprocket, and plate combination allows a workpiece to pass within the center of the unit and rest upon the supports 20 and 21.

Referring now to FIG. 1, there is shown mounted on the plate 15 two fixed shafts 17 and 18 upon which two rolls of tape 23 and 24 are mounted. A transparent cover 25 is placed over the tape and tightened down by a hand knob 19 to secure the tape in position. A lever 26 is also mounted to the plate 15 rotatably fixed about a pin 27, with a spring 28 connected between the lever 26 and a support pin 29. The lever 26 is positioned in such a fashion that the potential force developed through the spring allows the lever to apply direct pressure to the roll of tape to supply a predetermined tension. A set of friction guide pins 30 and 31 is connected to the plate 15 in such a fashion that pin 30 is disposed to rotate about pin 31. When tape is passed over pin 30 and around pin 31, this set of guide pins is adjustable so that the tension of the tape coming off the roll can be increased or decreased depending upon the position of pin 30. There is also connected to the plate a set of fixed supports 33 with a pin 40 passing therethrough and connecting another set of guide pin 34 to the support so that the guide pin 34 may rotate about the pin 40 at the support 33. The rotation of the guide pins 34 allows the pitch of the tape being supplied to a workpiece to be changed in such a fashion that the tape when wrapped around the workpiece makes a helical type wrap according to the predetermined pitch angle set at the guide pin 34 and the support 33.

When the tape rolls are installed on the support shafts as shown, tape is passed through the guide pins 30 and 31 and through the guide pin 34 and connected to a workpiece that rests upon the supports 20 and 21. When the operator operates the air gun through the right angle drive unit 7, the gear sprocket 6 is disposed to drive the chain and the chain in turn drives the drive sprocket 12 and the plate 15 connected thereto so that the tape is unwound from the tape roll and wrapped to the workpiece as the operator moves the machine along the length of the workpiece. As the rolls of tape are depleted, wrap force required to pull the tape from the roll is constantly increasing. However, as the roll of tape becomes smaller in diameter, the lever applies an offsetting decreasing force to the roll as the spring moves from its expanded position to its unexpanded position thus maintaining constant tension supplied to the workpiece at all times during the wrapping operation. It is readily seen that the advantages of this new tape wrapping machine greatly increases the efficiency and productivity of tape wrapping operations. This apparatus combines the advantages of having a small lightweight portable hand-held tape wrapping machine with the advantage of having a unit that applies constant tension to the workpiece at all times during the tape wrapping operation by utilizing a unique method of compensating for the inherent tendency of the tape tension to increase as the roll is depleted.

I claim:

1. Tape wrapping apparatus, comprising:

(a) a support frame;

(b) rotating means rotatably disposed upon the support frame for rotating about a workpiece which is to be taped;

(c) spool means disposed upon the rotating means for feeding tape to the workpiece as the rotating means rotates for tape wrapping the workpiece;

(d) spring biased tension maintenance means disposed on the rotating means in a disposition of forceful contact with the tape on the spool means whereby the biasing of the spring biased tension maintenance means is automatically reduced for automatically adjusting to keep the tension on the tape generally constant as the tape is unwound from the spool means during a tape wrapping operation for thus producing a generally uniformly tape wrapped workpiece; and (e) driving means interconnected with the rotating means for causing rotation thereof.

2. The combination as claimed in claim 1 comprising tension adjustment means disposed upon said rotating means in a disposition of contact with said tape for adjustably increasing said generally constant tension.

3. The combination as claimed in claim 2 wherein said tension adjustment means comprises a first pin disposed on said rotating means and a second pin disposable at a position within a range of positions on said rotating means, said tape being passed over said first pin and under said second pin as said workpiece is tape wrapped for adjustably increasing said generally constant tension as a function of the chosen position of said second pin relative to said first pin on said rotating means.

* * * * *